United States Patent [19]

Tamamura et al.

[11] 4,392,025

[45] Jul. 5, 1983

[54] CONDENSER MICROPHONE

[75] Inventors: Junichi Tamamura, Yao; Mamoru Yasuda; Motomi Hosoda, both of Kashiwara; Shinichi Saeki, Yao, all of Japan

[73] Assignee: Hosiden Electronics Co., Ltd., Osaka, Japan

[21] Appl. No.: 267,461

[22] Filed: May 27, 1981

[51] Int. Cl.[3] ..... H04R 19/04; H04R 1/22

[52] U.S. Cl. ..... 179/111 R; 179/121 R; 179/140

[58] Field of Search ..... 179/111 R, 106, 111 E, 179/121 R, 138, 140

[56] References Cited

U.S. PATENT DOCUMENTS 3,963,881 6/1976 Fraim et al. ..... 179/111 E

*Primary Examiner*—Stafford D. Schreyer

*Attorney, Agent, or Firm*—Steele, Gould & Fried

[57] ABSTRACT

A condenser microphone in which a back electrode, disposed oppositely to the rear surface of a diaphragm, and a circuit assembling plate disposed oppositely to the rear surface of the back electrode, are held in a holder.

Electronic circuit elements are attached to only one surface of the circuit assembling plate, and the other surface thereof is faced toward the rear surface of the back electrode with a predetermined distance provided therebetween. A back chamber, defined by a space between the back electrode and the circuit assembling plate, and enclosed by the holder improves the characteristics of microphone frequency response.

1 Claim, 5 Drawing Figures

CONDENSER MICROPHONE

BACKGROUND OF THE INVENTION

The present invention relates to a condenser microphone in which a diaphragm and a back electrode are disposed oppositely to each other, a back chamber to improve the characteristics of microphone frequency being formed at the side of that rear surface of the back electrode which is not faced toward the diaphragm.

Conventional condenser microphones of this kind comprise a diaphragm, a back electrode disposed under the diaphragm, a back-chamber-constituting plate disposed under the back electrode, a circuit assembling plate disposed under the back-chamber-constituting plate, a plurality of electronic circuit elements including a preamplifier attached to the upper surface of the circuit assembling plate, and a space between the back electrode and the back-chamber-constituting plate forming a back chamber.

Such conventional condenser microphone can advantageously obtain the optimum characteristics of microphone frequency response, since the back-chamber-constituting plate so disposed as to permit the distance between the back electrode and the back-chamber-constituting plate, i.e. the capacity of the back chamber, to be freely changed.

On the other hand, however, such conventional condenser microphones are deficient in that the microphone structure is complicated.

The electronic circuit elements are soldered to that lower surface of the circuit assembling plate to which such electronic circuit elements are not attached. This soldering lower surface is not faced toward the inside of the microphone or the back electrode, but is faced toward the outside with respect to the microphone. Thus, such a soldering lower surface is susceptible to adverse influences from external noise, and therefore should be covered with a shield plate.

Accordingly, in addition to the back-chamber-constituting plate, such a shield plate is necessarily required, thereby disadvantageously increasing the number of members constituting the microphone.

Conventional condenser microphones of another type are known in which the back-chamber-constituting plate in the conventional condenser microphone above-mentioned, is eliminated.

In such a condenser microphone, the back chamber is formed between the back electrode and the circuit assembling plate. Thus, such a condenser microphone is advantageously constructed in such a manner as not to require the back-chamber-constituting plate. However, due to the presence of the electronic circuit elements, the distance between the back electrode and the circuit assembling plate cannot be reduced below a predetermined distance, so that the capacity of the back chamber cannot be reduced below a predetermined value. Thus, there is a case where the optimum characteristics of microphone frequency response cannot be obtained.

Furthermore, such a conventional condenser microphone necessarily requires a shield plate, so that reduction in the number of members constituting the microphone and simplification of the microphone structure cannot be realized.

SUMMARY OF THE INVENTION

It is an object of the present invention to provide a condenser microphone in which the capacity of the back chamber can be freely changed, so that the characteristics of microphone frequency response can be optimized.

It is another object of the present invention to provide a condenser microphone which is not susceptible to adverse influences from external noise, even though a shield plate is not utilized.

It is a further object of the present invention to provide a condenser microphone in which the number of members constituting the microphone is drastically reduced and the microphone structure is simplified as much as possible.

In order to achieve these objects above-mentioned, the condenser microphone in accordance with the present invention is constructed in such a manner that the rear surface of the back electrode, which is not faced toward the diaphragm, is faced toward the soldering surface of the circuit assembling plate (the surface to which electronic circuit elements are not attached), and there is formed, as a back chamber, a space between the back electrode and the circuit assembling plate, such space being closed by a holder which holds the back electrode and the circuit assembling plate.

According to the present invention, the distance between the back electrode and the circuit assembling plate can be freely determined without interfering with the electronic circuit elements. Thus, without the use of a back-chamber-constituting plate, the capacity of the back chamber can be freely determined so as to obtain the optimum characteristics of microphone frequency response.

According to the present invention, since the soldering surface of the circuit assembling plate is faced toward the back electrode, and subsequently to the inside of the microphone, no adverse influences from external noise are exerted even though no shield plate is disposed.

According to the present invention, neither a back-chamber-constituting plate nor a shield plate are required, so that the number of members constituting the microphone can be reduced and the microphone structure can be greatly simplified.

BRIEF DESCRIPTION OF THE DRAWINGS

The present invention will be further described, by way of example, with reference to the accompanying drawings, in which.

DETAILED DESCRIPTION OF THE PREFERRED EMBODIMENT

Figure 1:
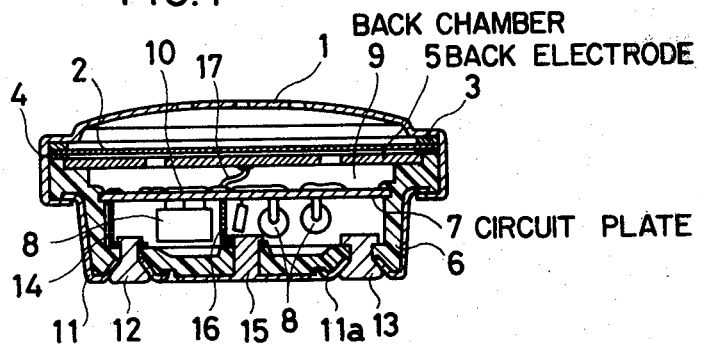
FIG. 1 is a section view of a telephone transmitter incorporating a condenser microphone in accordance with the present invention.

FIG. 1 is a section view illustrating a telephone transmitter incorporating an electret condenser microphone in accordance with the present invention.

A ring 3 is inserted into an upper case 1 having in the top surface thereof a plurality of openings. Integrally disposed under the ring 3 is a diaphragm 2 made of a thin plate to which metal is coated by vaporization.

A back electrode 5 having a plurality of openings is disposed under the diaphragm 2 spaced therefrom by a thin annular spacer 4, so that a predetermined capacity is provided between the diaphragm 2 and the back electrode 5.

The back electrode 5 is held by a cylindrical back electrode holder 6 made of a synthetic resin. This holder 6 has, at a predetermined height, a step 6*a* at which the inner diameter of the holder 6 is reduced.

A circuit assembling plate 7 such as a printed circuit board is secured to the upper side of the step 6*a*, with that surface of the plate 7 to which a plurality of electronic circuit elements 8, such as a pre-amplifier, are attached, faced downward.

A plurality of electronic circuit elements 8 are attached only to the lower surface of the circuit assembling plate 7, and the soldered portions 10 at which the electronic circuit elements 8 are soldered, are present only on the upper surface of the circuit assembling plate 7 faced toward the back electrode 5.

Figure 3A:
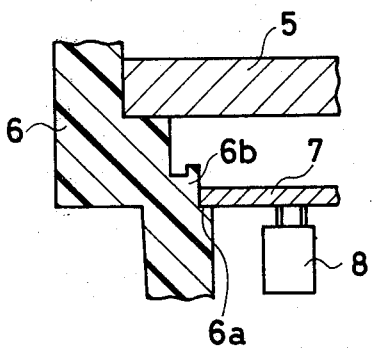
FIG. 3 (*a*) and FIG. 3 (*b*) are section views of main portions of the present condenser microphone, illustrating how to secure a circuit assembling plate to a holder.
Figure 3B:
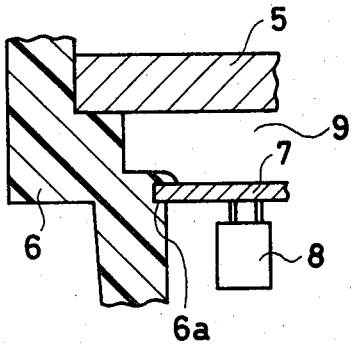

FIG. 3 (*a*) and FIG. 3 (*b*) are enlarged section views, illustrating how to mount the back electrode 5 and the circuit assembling plate 7 to the holder 6.

A flange 6*b* disposed around the entire upper periphery of the step 6*a* shown in FIG. 3 (*a*) is meltingly welded as shown in FIG. 3 (*b*). Thus, the circuit assembling plate 7 is secured into the back electrode holder 6, simultaneously with the formation of a back chamber 9 defined between the back electrode 5 and the circuit assembling plate 7. The electronic elements 8 constituting a pre-amplifier and others, are then held in the back electrode holder 6.

The capacity of the back chamber 9, i.e. the distance between the back electrode 5 and the circuit assembling plate 7 can be freely determined, since the heights of the soldered portions 10 positioned between the back electrode 5 and the circuit assembling plate 7 are extremely small. Accordingly, the capacity of the back chamber 9 can be determined so as to obtain the optimum characteristics of microphone frequency response.

The holder 6 is covered at the outer circumference thereof with a lower case 11, which serves also as a negative terminal and is secured to the holder 6 with rivets 12 and 13. The rivet 12 is secured to a relay terminal 14 soldered to the circuit assembling plate 7.

A rivet-shaped positive terminal 15 is secured to that portion of the holder 6 which is outwardly exposed from a bore 11*a* in the lower case 11. This positive terminal 15 is secured to a relay terminal 16 soldered to the circuit assembling plate 7. A lead wire 17 is soldered to the back electrode 5.

Figure 4:
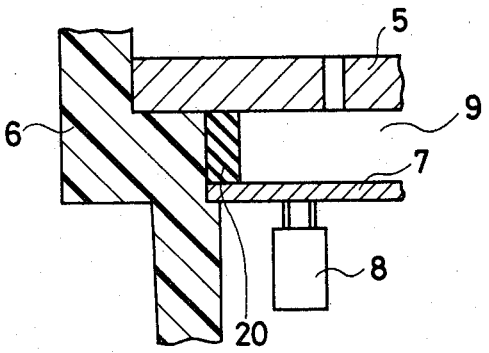
FIG. 4 is a section view similar to FIG. 3, but illustrating a different method of securing the circuit assembling plate to the holder.
Figure 2:
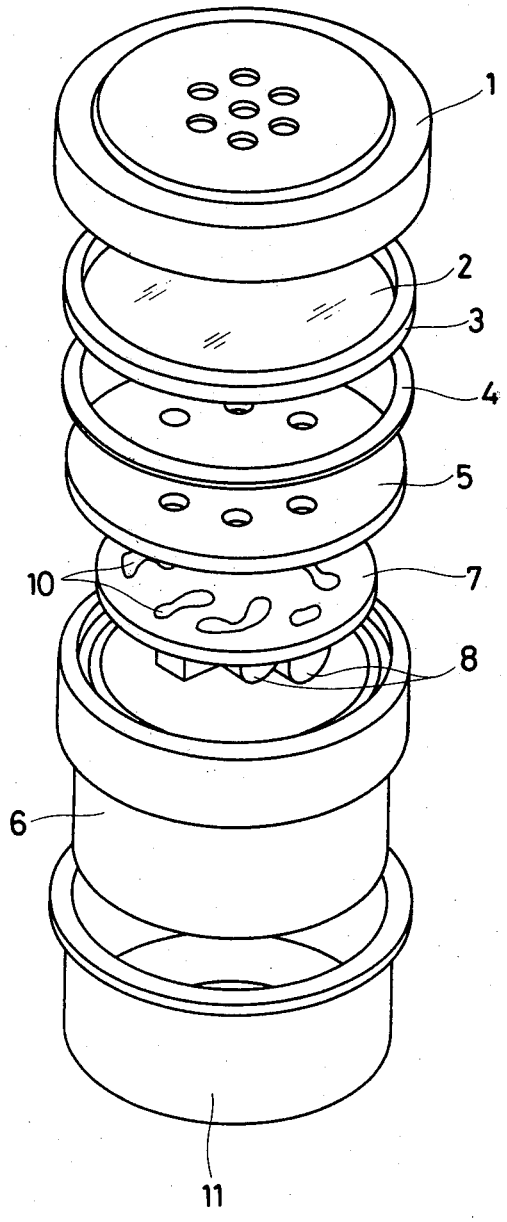
FIG. 2 is a disassembled perspective view of main portions of the telephone transmitter in FIG. 1.

Although, in the embodiment discussed hereinbefore, the circuit assembling plate 7 is secured into the back electrode holder 6 by welding the flange 6*b* of the back electrode holder 6, such plate 7 may also be secured with the use of adhesives. Alternately, the plate 7 may also be secured with the use of packing member 20 made of a resilient material such as rubber, as shown in FIG. 4.

It is to be understood that the present invention may be applied not only to an electret condenser microphone in which electric charge is secured to a diaphragm or a back electrode, but also to a normal condenser microphone.

What is claimed is:

1. A condenser microphone, comprising:

a diaphragm to be vibrated in response to an input sound;

a back electrode, having at least one opening therethrough, disposed oppositely to said diaphragm;

a circuit assembling plate having one surface only to which a plurality of electronic circuit elements are attached; and, a holder for holding said back electrode and said circuit assembling plate in an orientation where that surface of said back electrode which is not faced toward said diaphragm, is faced toward that surface of said circuit assembling plate to which said electronic circuit elements are not attached, with a predetermined distance provided between said back electrode and said circuit assembling plate, said holder defining a back chamber in a space between said back electrode and said circuit assembling plate, said back chamber being closed except for said at least one opening in said back electrode.

* * * * *

UNITED STATES PATENT AND TRADEMARK OFFICE

CERTIFICATE OF CORRECTION

PATENT NO. : 4,392,025

DATED : July 5 1983

INVENTOR(S) : Junichi Tamamura et al.

It is certified that error appears in the above-identified patent and that said Letters Patent are hereby corrected as shown below:

Column 1, Line 21: delete "microphone", and insert --microphones--.

Column 1, Line 24: between "plate" and "so", insert --is--.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*